US008684204B2

(12) United States Patent
Belle

(10) Patent No.: US 8,684,204 B2
(45) Date of Patent: Apr. 1, 2014

(54) LOCKING COVER FOR A VESSEL HAVING A NECK, INCLUDING A CAP HAVING ATTACHMENT TABS

(75) Inventor: Guillaume Belle, Sassenage (FR)

(73) Assignee: A. Raymond et Cie, Grenoble (FR)

( * ) Notice: Subject to any disclaimer, the term of this patent is extended or adjusted under 35 U.S.C. 154(b) by 0 days.

(21) Appl. No.: 13/387,427

(22) PCT Filed: Aug. 25, 2010

(86) PCT No.: PCT/EP2010/062413
§ 371 (c)(1),
(2), (4) Date: Jan. 27, 2012

(87) PCT Pub. No.: WO2011/039004
PCT Pub. Date: Apr. 7, 2011

(65) Prior Publication Data

US 2012/0187072 A1 Jul. 26, 2012

(30) Foreign Application Priority Data

Oct. 1, 2009 (FR) ..... 09/56836

(51) Int. Cl.
*A61B 19/00* (2006.01)
*B65D 45/32* (2006.01)

(52) U.S. Cl.
CPC ..... *B65D 45/32* (2013.01)
USPC ..... 215/274; 604/411; 604/415; 220/801

(58) Field of Classification Search
USPC ..... 220/801, 315, 802, 800, 319; 215/249, 215/247, 272, 273, 277, 296, 297, 274, 364, 215/355; 604/415, 411, 905, 256, 201, 200
See application file for complete search history.

(56) References Cited

U.S. PATENT DOCUMENTS 2,162,752 A 6/1939 Schauer
2,162,754 A 6/1939 Schauer (Continued)

FOREIGN PATENT DOCUMENTS

DE 9306796U1 U1 7/1993
DE 19708909 9/1998

(Continued)

OTHER PUBLICATIONS

Office Action from Canadia I.P. Office for Application No. 2,773,172 dated Mar. 28, 2013.

(Continued)

*Primary Examiner* — Robert J Hicks
*Assistant Examiner* — Kareem Rush
(74) *Attorney, Agent, or Firm* — Harness, Dickey & Pierce, P.L.C.

(57) ABSTRACT

The invention relates to a locking cover (1), made of a molded plastic material, for a vessel having a neck, intended for locking a plug (4) in the neck (3) of the vessel (2), including a wire-cap (6) which surrounds the plug and the neck, a ring (7) which is attached around the wire-cap (6) and shaped so as to have a central opening (17) providing access from the outside of the cover (1) to the inside of the vessel via the plug, and a cap (23) attached to the ring and shaped so as to close said opening (17). The cap (23) comprises attachment tabs (25) which are spaced apart from each other along the annular periphery of the opening (17) of the ring (7) and which are clamped between the ring (7) and the wire-cap (6).

28 Claims, 2 Drawing Sheets

(56) References Cited

U.S. PATENT DOCUMENTS

| | | | | | |
|---|---|---|---|---|---|
| 2,961,119 | A | | 11/1960 | Leach | |
| 3,117,701 | A | | 1/1964 | Stull | |
| 3,193,128 | A | | 7/1965 | Ravn | |
| 3,603,471 | A | | 9/1971 | Harris, Sr. et al. | |
| 3,823,841 | A | | 7/1974 | Lovejoy | |
| 3,920,141 | A | | 11/1975 | Bojardi | |
| 4,211,333 | A | | 7/1980 | Villarejos | |
| 4,251,003 | A | | 2/1981 | Bodenmann | |
| 4,456,138 | A | | 6/1984 | Bereziat | |
| 5,085,332 | A | * | 2/1992 | Gettig et al. | 215/249 |
| 5,088,612 | A | * | 2/1992 | Storar et al. | 215/247 |
| 5,125,921 | A | | 6/1992 | Duschek | |
| 5,303,835 | A | | 4/1994 | Haber et al. | |
| 5,305,835 | A | | 4/1994 | Campbell et al. | |
| 5,314,084 | A | * | 5/1994 | Folta et al. | 215/249 |
| 5,467,878 | A | | 11/1995 | Derksen | |
| 5,555,988 | A | * | 9/1996 | Koch et al. | 215/249 |
| 5,562,219 | A | * | 10/1996 | de Pous et al. | 215/274 |
| 5,590,782 | A | * | 1/1997 | Haber et al. | 206/528 |
| 5,738,233 | A | | 4/1998 | Burns | |
| 5,799,810 | A | | 9/1998 | de Pous et al. | |
| 5,817,082 | A | | 10/1998 | Niedospial, Jr. et al. | |
| 5,819,964 | A | | 10/1998 | Grimard | |
| 5,823,373 | A | | 10/1998 | Sudo et al. | |
| 5,957,314 | A | | 9/1999 | Nishida et al. | |
| 5,972,297 | A | | 10/1999 | Niermann et al. | |
| 5,992,660 | A | | 11/1999 | Miura et al. | |
| 6,042,770 | A | | 3/2000 | Sudo et al. | |
| 6,095,355 | A | | 8/2000 | Jessen et al. | |
| 6,186,359 | B1 | | 2/2001 | de Pous et al. | |
| 6,341,706 | B1 | | 1/2002 | Neuner | |
| 6,378,714 | B1 | | 4/2002 | Jansen et al. | |
| 6,409,049 | B1 | | 6/2002 | de Pous et al. | |
| 6,543,648 | B2 | | 4/2003 | de Pous et al. | |
| 6,568,439 | B1 | | 5/2003 | Se et al. | |
| 6,588,614 | B2 | | 7/2003 | Neuner | |
| 6,591,998 | B2 | | 7/2003 | Haynes et al. | |
| 6,601,721 | B2 | | 8/2003 | Jansen et al. | |
| 6,604,561 | B2 | | 8/2003 | Py | |
| 6,681,475 | B2 | | 1/2004 | Jansen et al. | |
| 6,739,781 | B2 | | 5/2004 | Maloney et al. | |
| 6,868,978 | B2 | | 3/2005 | Amschlinger et al. | |
| 6,904,662 | B2 | | 6/2005 | Thibault et al. | |
| 7,100,646 | B2 | | 9/2006 | Py et al. | |
| 7,198,757 | B2 | | 4/2007 | Chiarin | |
| 7,243,689 | B2 | | 7/2007 | Py | |
| 7,309,469 | B2 | | 12/2007 | Anderson et al. | |
| 7,488,307 | B2 | | 2/2009 | Rimlinger et al. | |
| 7,490,639 | B2 | | 2/2009 | Py | |
| 7,562,783 | B2 | | 7/2009 | Bourreau et al. | |
| 7,611,025 | B2 | | 11/2009 | Nusbaum et al. | |
| 7,611,026 | B1 | | 11/2009 | Bloom et al. | |
| 7,712,618 | B2 | | 5/2010 | Barre et al. | |
| 7,726,357 | B2 | | 6/2010 | Py et al. | |
| 7,810,529 | B2 | | 10/2010 | Py | |
| 7,841,484 | B2 | | 11/2010 | Kaneko et al. | |
| 7,845,505 | B2 | | 12/2010 | Hamamoto et al. | |
| 7,850,028 | B2 | | 12/2010 | Morini | |
| 7,922,019 | B2 | | 4/2011 | Granger | |
| 7,967,034 | B2 | | 6/2011 | Py | |
| RE42,553 | E | | 7/2011 | de Pous et al. | |
| 7,980,276 | B2 | | 7/2011 | Py | |
| 8,056,756 | B2 | | 11/2011 | Okiyama | |
| 8,225,949 | B2 | | 7/2012 | Aneas | |
| 8,303,914 | B2 | | 11/2012 | Zurcher | |
| 2003/0098286 | A1 | | 5/2003 | Bloom et al. | |
| 2003/0108455 | A1 | | 6/2003 | Brockwell | |
| 2004/0217081 | A1 | | 11/2004 | Konrad | |
| 2007/0102393 | A1 | | 5/2007 | Colin et al. | |
| 2007/0131641 | A1 | | 6/2007 | Higgins | |
| 2008/0105640 | A1 | | 5/2008 | Ott | |
| 2008/0237178 | A1 | | 10/2008 | Ochoa Laburu | |
| 2010/0050575 | A1 | * | 3/2010 | Aneas | 53/485 |
| 2010/0089862 | A1 | | 4/2010 | Schmitt | |
| 2010/0243599 | A1 | | 9/2010 | Chae | |

FOREIGN PATENT DOCUMENTS

| | | | |
|---|---|---|---|
| FR | 2036746 | | 12/1970 |
| FR | 2908396 | A1 | 5/2008 |
| FR | 2912384 | A1 | 8/2008 |
| JP | 378947 | | 1/1960 |
| JP | 7165252 | | 6/1995 |
| JP | 2007-137482 | A | 6/2007 |
| WO | WO94/04424 | A1 | 3/1994 |
| WO | WO-9953886 | A1 | 10/1999 |
| WO | WO01/60699 | A2 | 8/2001 |
| WO | 2006/120539 | | 11/2006 |

OTHER PUBLICATIONS

Office Action from Korean I.P. Office for Application No. 10-2012-7009278 dated Jun. 28, 2013.

Office Action from Japanese I.P. Office for Application No. 2012-531304 dated Jun. 25, 2013.

Examination Report from New Zealand I.P. Office for Application No. 598359 dated Nov. 8, 2012

* cited by examiner

LOCKING COVER FOR A VESSEL HAVING A NECK, INCLUDING A CAP HAVING ATTACHMENT TABS

CROSS-REFERENCE TO RELATED APPLICATION

This application is a U.S. National Phase Patent Application based on International Application Serial No. PCT/EP2010/062413 filed Aug. 25, 2010, the disclosure of which is hereby explicitly incorporated by reference herein.

BACKGROUND OF THE INVENTION

1. Field of the Invention

The present invention concerns a locking cover made of a molded plastic material for a vessel having a neck.

2. Description of the Related Art

FR-2893922 discloses such a locking cover in which the cap is welded onto the ring. To access the contents of the vessel, the user breaks the connection between the cap and the ring, with the result that the cap is separated irreversibly from the cover, thus securizing the use of the vessel provided with said cover.

SUMMARY OF THE INVENTION

The present invention concerns a locking cover made of a molded plastic material for a vessel having a neck, intended for fixing a stopper in the neck of the vessel, comprising a cage with locking tongues or catches, which is configured to surround the stopper and the neck and lock them in position relative to each other in a given axial direction, a ring that is fastened around the cage and is configured with a central aperture that preserves access from outside the cover to the inside of the vessel by way of the stopper, and a cap configured to close said aperture.

This cap, cover or lid is generally fastened to the ring in such a way that it can be detached therefrom, but in an irreversible manner, without the ability to be put back in place in its initial state of closing the aperture.

The invention applies more particularly to a locking cover for a necked vessel used particularly in the medical field.

The object of the invention is to offer such a locking cover in which the cap is mounted on the cover in another manner that also permits irreversible separation of the cap from the cover.

To this end, the invention is directed to a locking cover made of a molded plastic material for a vessel having a neck, intended to fix a stopper in the neck of the vessel, comprising a cage with locking catches which is configured to surround the stopper and the neck and lock them in position relative to each other in a given axial direction, a ring that is fastened around the cage and is configured with a central aperture preserving access from outside the cover to the inside of the vessel by way of the stopper, and a cap configured to close said aperture, characterized in that the cap has a flat head large enough to cover said aperture and attachment tabs that project substantially perpendicularly to the head, said tabs being spaced apart along the annular periphery of the aperture of the ring and being gripped as in a vice between the ring and the cage.

The idea underlying the invention is, therefore, to fasten the cap to the cover by means of a clamping system of attachment tabs for fastening the cap in the cover, which system applies a clamping stress to both faces of each tab and/or a bending stress to the tabs in a direction oblique (for example, perpendicular) to the axial direction, thus rendering irreversible the detachment of the cap from the cover and also preventing any new cap from being placed on the cover.

The invention extends to a method for fastening a cap with attachment tabs on a locking cover as defined above, consisting in:

providing a cap with attachment tabs projecting perpendicularly to the flat head of the cap, placing the cap on the ring, the tabs of the cap extending axially into the aperture of the ring, inserting the cage into the ring so that the tabs of the cap are gripped, as in a vice, between the ring and the cage.

In one form thereof, the present invention provides a locking cover made of a molded plastic material for a vessel having a neck, intended to fix a stopper in the neck of the vessel, including a cage with locking tabs that is configured to surround the stopper and the neck and to lock them in position relative to each other in a given axial direction, a ring that is fastened around the cage and is configured with a central aperture that preserves access from outside the cover to the inside of the vessel by way of the stopper, and a cap configured to close the aperture, characterized in that the cap has a flat head large enough to cover the aperture and attachment tabs that project substantially perpendicularly relative to the head, the attachment tabs being spaced apart along the annular periphery of the aperture of the ring and being gripped as in a vice between the ring and the cage.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
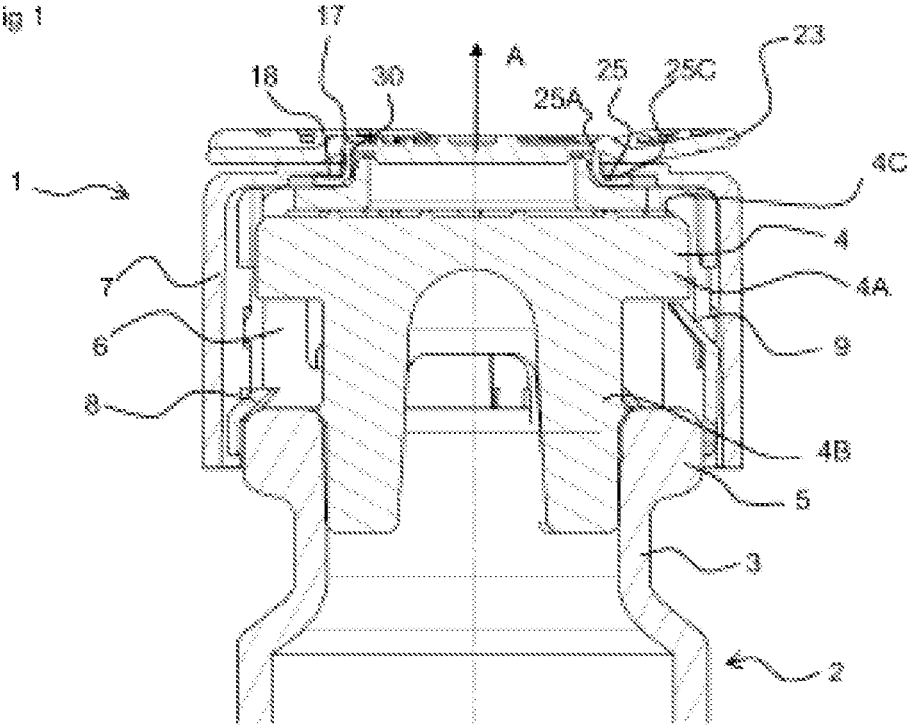
FIG. 1 schematically represents in axial section a locking cover according to the invention mounted on a stopper inserted in a vessel having a neck.

Corresponding reference characters indicate corresponding parts throughout the several views. Although the exemplifications set out herein illustrate embodiments of the invention, in several forms, the embodiments disclosed below are not intended to be exhaustive or to be construed as limiting the scope of the invention to the precise forms disclosed.

DETAILED DESCRIPTION

FIG. 1 depicts a locking cover 1 for a vessel 2 having a neck 3 according to the invention, intended to fix a stopper 4 in the neck 3 of the vessel 2, the cover 1 being shown here merely placed on the neck 3 without being locked.

The neck 3, which here has a circular opening, has at its end an outer peripheral lip 5 to which the locking cover 1 fixes itself when the cover 1 is locked on the neck 3 of the vessel 2. The stopper 4 here has a conventional, generally cylindrical, "T" shape, with a head 4A and a foot 4B, the head being slightly larger in diameter than the foot 4B, such that when the foot 4B of the stopper 4 is inserted in the neck 3, the head 4A abuts against the lip 5 of the neck 3.

As can be seen in FIG. 1, the locking cover 1 comprises a cage 6 adapted to surround the stopper 4 and the neck 3 in the locked configuration of the cover 1 on the vessel 2, and a ring 7 adapted to nest over the cage 6, surrounding it. The cage 6 serves to fix the stopper 4 in the neck 3 by means of flexible tongues 8, 9 disposed on the periphery of the cage 6. In the mounted configuration of the cover 1, the ring 7 laterally overlaps the cage 6 completely, thereby preventing any access to the cage 6 and the tongues 8, 9 from outside the ring 7.

In addition, according to the invention, the cover 1 is provided with a removable safety cap 23 that is clamped between the ring 7 and the cage 6.

Figure 2:
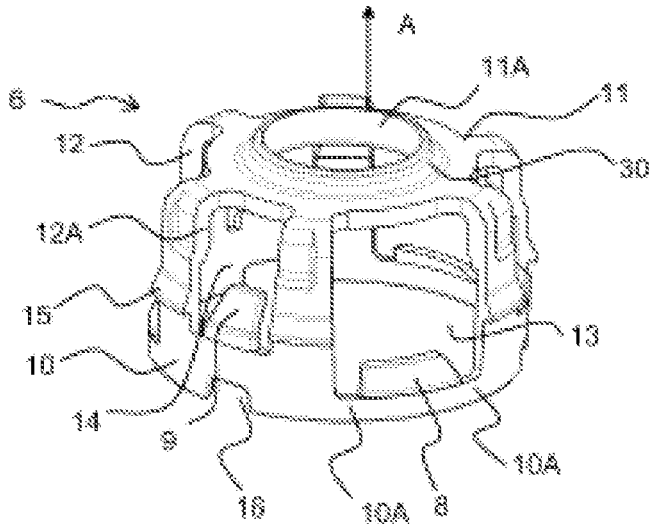
FIG. 2 is a schematic perspective view of the cage of the locking cover according to the invention.

As can be seen in FIG. 2, the cage 6 comprises two circlets 10, 11 connected to each other by a plurality of substantially identical arms 12 extending in an axial direction A and forming between them first and second openings 13, 14 corresponding to the mesh openings of the cage 6.

Depicted here are a first, lower circlet 10 that is to be inserted first into the neck 3 of the vessel 2, and a second, upper circlet 11, which is preferably smaller in diameter than the first circlet 10 and is intended to rest on an upper portion 4C of the head 4A of the stopper 4 when the cover 1 is mounted on the stopper 4. Circlet 11 defines, at the center of the cage 6, an aperture 11A—here circular—that is coaxial with the neck 3 of the vessel 2 when the cover 1 is placed on the neck 3, to permit access to the stopper 4 and the vessel 2.

It will be understood that circlet 11 and the arms 12 are sufficiently rigid so that they do not collapse as the cage 6 is inserted in the ring 7.

Shown here are six arms 12 evenly distributed over the periphery of the circlets 10, 11, but their number can vary without departing from the framework of the invention.

As visible in FIG. 2, first flexible tongues 8 adapted to fix themselves to the neck 3 of the vessel 2 and second flexible tongues 9 adapted to fix themselves to the stopper 4—here, three of each—are disposed, preferably in alternation, on the periphery of circlet 10 between two consecutive arms 12.

The first and second tongues 8, 9 are disposed slantingly in, respectively, the first and the second openings 13, 14 formed by the mesh openings of the cage 6, and are supported by circlet 10 and extend toward the inside of the cage 6 and in the direction of second circlet 11. In this way, when the cage 6 is inserted onto the neck 3 or the stopper 4, the first and second tongues 8, 9 can, in a first stage, deflect elastically into the first and the second openings 13, 14, respectively, assuming a position substantially parallel to the arms 12, and then, in a second stage, resume their slanted position to lock the cage 6 respectively on the neck 3 or on the stopper 4.

As visible in FIG. 2, the first tongues 8 are offset in axial direction A with respect to the second tongues 9. More precisely, the second tongues 9 are raised in the direction of the second circlet 11, such that the distance between the end of a second tongue 9 and circlet 11 substantially corresponds to the height of the head 4A of the stopper 4, so as to lock the head 4A of the stopper 4 between second tongues 9 and circlet 11. Likewise, the distance between the end of a first tongue 8 and circlet 11 is adapted to lock the first tongues 8 against the lip 5 of the neck 3 of the vessel 2 when the cap 1 is locked on the neck 3.

As represented in FIG. 2, disposed on one and the other side of each first tongue 8 are regions 10A of first circlet 10 that are relatively thin compared to the thickness of the mesh openings, thus forming cut-downs on each side of the tongue 8 and making these regions into breakaway regions that yield if an attempt is made to remove the cage 6 from the vessel 2. It will be understood that regions 10A represent the smallest wall section of the cage 6. Thus, as the cover 1 is locked onto the neck 3 by the application of an axial or other force to the cage 6, the first tongues 8 are retained by the lip 5, thereby producing a torsion torque in regions 10A. One or more of these regions 10A can then break under the effect of the torsion and indicate that the vessel 2 has been opened. It will be noted that tongues 8 here are shaped in such a way that their height allows them to pass under the lip 5 of the neck 3 of the vessel 2, and a pull exerted on the cage 6 causes them to rotate under the lip 5, thus further increasing the torsion effect in regions 10A.

It will be noted that first tongues 8 and the corresponding openings 13 here are wider than second tongues 9 and the corresponding openings 14, thus making it possible for the cage 6 to be fixed more firmly to the neck 3 than to the stopper 4.

As can be seen in FIG. 2, each arm 12 of the cage 6 is further provided with an outer positive catch 15 that slants outward toward the first circlet 10 and is intended to fix the ring 7 on the cage 6, the inclination of the catch 15 serving to facilitate the insertion of the cage 6 in the ring 7.

It can also be seen in FIG. 2 that each arm 12 of the cage 6 is reinforced, at the level of its upper portion adjoining second circlet 11, by an inner bulge 12A intended to clamp the stopper 4 in place in the mounted position of the cover 1.

In addition, formed on circlet 10 of the cage 6, opposite every second tongue 9, are respective notches 16 (here, three in number) intended to assist in orienting the cage 6 with respect to an automatic assembly machine during the assembly of the cage 6 and the ring 7 to form the cover 1.

As can further be seen in FIG. 2, the top edge of aperture 11A of the cage forms a chamfered (beveled) annular shoulder 30. This chamfered shoulder can be bordered outwardly by an annular channel or groove (not shown) to improve the seating of the attachment tabs of the cap 23. The shoulder 30 thus has a tapered (or flared) outer surface forming one face of a vice in which the attachment tabs of the cap 23 will be gripped, as will be described below with reference to FIGS. 1 and 7.

Figure 3:
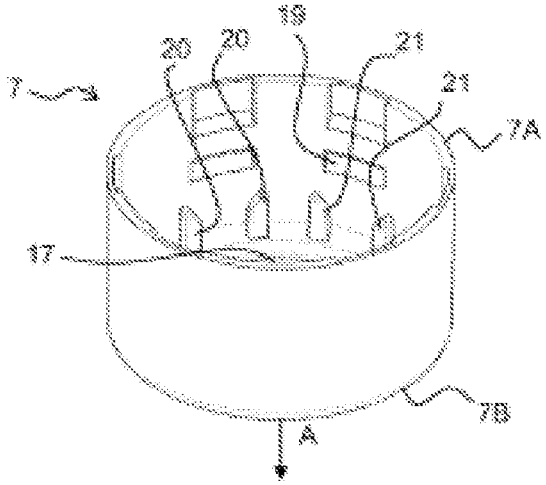
FIG. 3 is a schematic perspective view of the ring of the locking cover according to the invention.

FIG. 3 represents the ring 7 in the form of a sleeve having a continuous, substantially cylindrical surface, which in the mounted configuration of the cover 1 surrounds the cage 6 to prevent access to the tongues 8, 9.

The ring 7 has an open bottom end 7A that is to be inserted first onto the cage 6 and a top end 7B that is partially closed, so as to leave an aperture 17 at the center of the ring 7. Thus, when the ring 7 is nested on the cage 6, the top end 7B of the ring 7 partially overlaps the cage 6, the respective apertures 17, 11A of the ring 7 and the cage 6 being coaxial. When the cap 1 is mounted on the neck 3, apertures 17, 11A thus are coaxial with the neck 3, to permit access to the stopper 4 and the vessel 2.

Aperture 17 of the ring 7 has a bottom edge, which also forms an annular shoulder 18 that forms the second face of the vice in which the attachment tabs of the cap 23 are gripped. In the example, the two annular shoulders 18 and 30 here are circular and coaxial with each other in the mounted position of the cover. It can be provided that the cage 6 and the ring 7 are adjusted in relation to each other so that the attachment tabs 25 are clamped between the faces or jaws of the vice. It can also be provided that instead of or in addition to the clamping, the vice is configured to bend an end portion of the attachment tabs 25 in a direction oblique to axial direction A (for example perpendicular, that is, forming a 90° angle with axial direction A).

In addition, ring 7 is provided on its inner wall with notches 19 designed to cooperate with the catches 15 of the cage 6 to form an interlock device that locks the ring 7 on the cage 6. The notches 19 are preferably blind, that is, they do not pass all the way through the wall of the ring 7, to make for a compact cover 1 and to keep impurities from getting inside the cover 1.

The ring 7 is further provided on its inner wall with internal guides 20, 21 intended to interpose themselves between the arms 12 of the cage 6 to guide the positioning of the cage 6 relative to the ring 7 as the cage 6 is inserted in the ring 7. It will be understood that the internal guides 20, 21 preferably have dimensions respectively adapted to openings 13, 14, with a height in the axial direction A that is less than the height of openings 13, 14, to enable the tongues 8, 9 to deflect into the openings 13, 14 when the cover 1 is inserted on the neck 3. Represented here for each guide 20, 21 is a pair of respective bosses that position themselves laterally in a mesh opening of the cage 6 respectively against adjacent arms 12 of the cage 6 when the ring 7 and the cage 6 are nested one inside the other. These bosses here have a beveled shape on the side abutting an arm 12, to further facilitate the guiding of the cage 6 into the ring 7.

Figure 4:
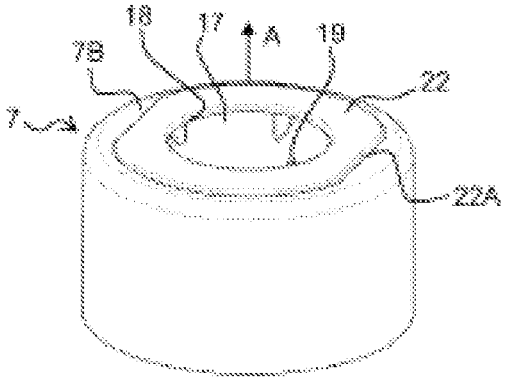
FIG. 4 is another schematic perspective view of the ring from FIG. 3.

As represented in FIG. 4, the top end 7B of the ring 7 is provided with a shoulder 22, circular in this case, which borders aperture 17 and is truncated to form two substantially parallel sides 22A, thus providing a means of orienting the ring 7 relative to the automatic assembly machine. Shoulder 22 serves to create a space between the cap 23 and the ring 7 in direction A, once the cover 1 is assembled.

Figure 5:
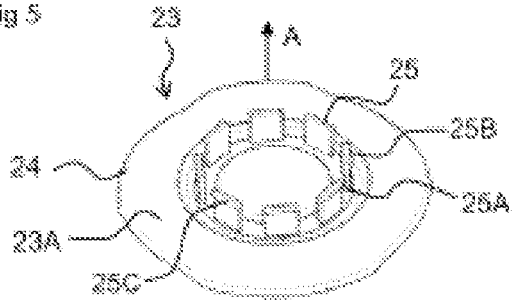
FIG. 5 is a schematic perspective view of the cap of the locking cover according to the invention.

FIG. 5 shows a cap 23 or cover serving as a detachable lid for closing the central aperture 17 of the ring. This cap has tabs 25 which in the non-working position project perpendicularly to the flat head 23A of the cap. The cap 23, with the flat head 23A and the tabs 25, is here formed of a single molded piece. The flat head 23A can have the shape of a disk or another, more complex shape, for example with sectors 24. The tabs 25 are distributed circularly, and, in mounted position in the ring 7, they are distributed along the periphery of the aperture 17 of the ring 7. As is visible in FIG. 5, the tabs 25 are straight in the non-working position, and thus present a cylindrical configuration. FIG. 5 shows a cap 23 with eight tabs 25, which can have a free end 25B that is beveled and/or provided with a locking bead 25C. The locking bead 25C preferably has larger dimensions than the space between the annular shoulder 18 of the ring 7 and the chamfered annular shoulder 30 of cage 6, to further improve the protection of the cover 1.

Figure 6:
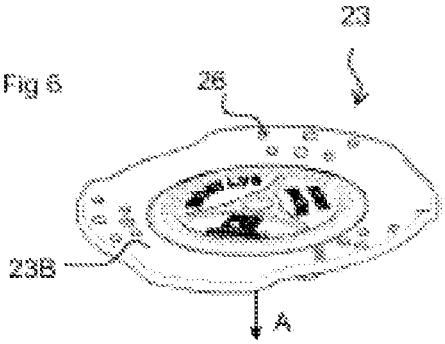
FIG. 6 is another schematic perspective view of the cap from FIG. 5.

FIG. 6 shows the upper face 23B of the cap 23, which can be provided with gripping elements 26, here in the form of reinforcing studs, to make the cap 23 easier to take hold of when it is to be removed from the cover 1. The gripping elements could also be in the form of raised beads, for example circular-arc-shaped beads, or any element in relief facilitating the grasping of the cap 23.

It will be understood that the overall cylindrical shape of the cage 6 and the ring 7 enables the cover 1 to adapt to all types of vessels 2 having a lipped circular neck 3 and does not require orienting either the cover 1 or the stopper 4 on the neck 3. Similarly, owing to the circular shape of the cap 23, there is no preferred angular orientation of the cap 23 on the ring 7.

The cage 6, the ring 7 and the cap 23 of the cover 1 are preferably made by molding a plastic material, adapted to withstand a lyophilization process if need be. In particular, the plastic material of the cage 6 is hard, so that the torsion described earlier above causes the breakaway regions 10A to break rather than just elastically deform.

The respective shapes of the cage 6, the ring 7 and the cap 23 are relatively simple, thus permitting the use of double-cavity molds with a single core and axial stripping, and, consequently, easy and inexpensive production. In addition, the simplified shapes of these elements advantageously make it possible to reduce the amount of material necessary for the production of the cover 1.

The assembly operations for the ring, the cage and the lid of the cover 1 will now be described in more detail with reference to FIGS. 1, 5 and 7.

A cap 23 is first provided with straight attachment tabs 25 that extend axially in relation to the flat head 23A of the cap, as can be seen in FIG. 5.

Figure 7:
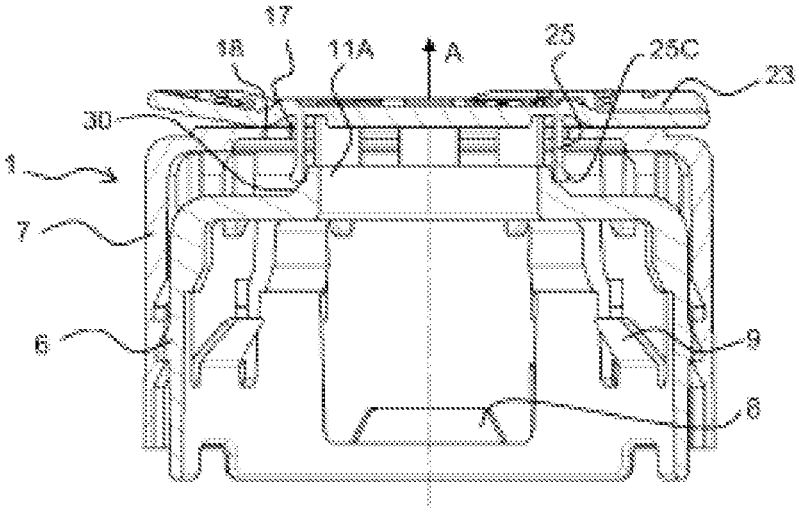
FIG. 7 schematically represents in axial section the locking cover according to the invention closed by a cap and mounted on a stopper.

This cap 23 is then placed on the ring 7, the sufficiently large head 23A of the cap covering the aperture 17 of the ring 7, as shown in FIG. 7, and the tabs 25 of the cap 23 passing through the aperture 17 of the ring 7, extending axially in direction A.

The cage 6 is then inserted into the ring 7 in direction A as far as it will go, the openings 13, 14 of the cage 6 being lined up with the respective bosses 20, 21 of the ring 7, as shown in FIG. 7.

During the insertion of the cage 6 into the ring 7, the annular shoulder 18 of the ring 7 and the chamfered annular shoulder 30 of the cage 6 are made to approach each other, which has the effect that each tab 25 of the cap 23 is held as in a vice between the two facing surfaces of the ring 7 and the cage 6 respectively, as can be seen in FIG. 1.

When the cage 6 reaches abutment inside the ring 7, the attachment tabs 25 of the cap 23 are deformed by bending, here in the middle portions of the tabs, and assume a configuration in which the tabs 25 splay out 90° from the axial direction A toward the outside of the cover 1, thus effecting the clamping of the cap 23 between the ring 7 and the cage 6. If need be, the beads at the free ends 25B of the attachment tabs 25 can be inserted in the groove of the cage 6.

It should be noted that the vice-like gripping of the attachment tabs 25 between the ring 7 and the cage 6 makes it possible to exceed the limit of elasticity of the attachment tabs 25, with the result that if the cap 23 is separated from the cover 1, the attachment tabs 25 of the cap 23 remain in a bent configuration. Thus, once the cap 23 has been separated from the cover 1, it can no longer be put back between the ring 7 and the cage 6 of the cover 1. It will be appreciated that this effect can be accentuated by the presence of beads at the free ends 25B of the attachment tabs 25.

When the cage 6 reaches abutment inside the ring 7, the catches 15 of the cage 6 seat themselves in the notches 19 of the ring 7, such that the cage 6 is locked in position in the ring 7 and the cap 23 remains clamped between the cage 6 and the ring 7.

The head 4A of the stopper 4 can then be inserted in the cage 6 until the upper portion 4C of the stopper 4 comes into contact with the upper circlet 11 of the cage 6. As the stopper 4 is inserted, the second tongues 9 deform elastically to let the stopper past and then go back to their initial shape once the stopper 4 is in place, positively engaging behind the head 4A of the stopper 4, so as to lock the stopper 4 in the position indicated in FIG. 4. The stopper 4 is then fixed over its periphery in the cage 6 by the bulges 12A, in the position indicated in FIG. 7.

The assembly formed by the locking cover 1 and the stopper 4 can then be mounted on a vessel 2 by inserting the foot 4B of the stopper 4 into the neck 3 of the vessel 2 simply by applying axial pressure to the cap 23 in direction A, thereby forcing the first tongues 8 to deform elastically in order to get past the lip 5 of the neck 3, and then to resume their initial shape so as to positively engage behind the neck 3 and lock the cover 1 on the neck 3. At the same time, the second tongues 9 partially deflect against the neck 3 of the vessel 2.

The result is a closure for the vessel 2 that is leaktight due to the stopper 4 and tamper-proof by virtue of the locking cover 1, since the cage 6 serves to lock the stopper 4 in the neck 3 and the ring 7 prevents any access to the cage 6, and in particular to the tongues 8, 9. It will be appreciated that the cage 6 therefore serves as a link that fastens together the vessel 2, the stopper 4 and the second ring 7 provided with the cap 23, and that the second ring 7 serves as a safeguard.

For some medical applications, it may be necessary to lyophilize the contents of the vessel 2. In that case, after contents for lyophilization have been introduced into the sterile vessel 2, the foot 4B of the stopper 4 locked in the cover 1 is placed in the neck 3 without pushing it all the way in and without engaging the first tongues 8 on the neck 3, in the position shown in FIG. 1. An opening in the foot 4B of the stopper 4 (not shown) then makes it possible to proceed with the desired lyophilization. Once the lyophilization has been performed, the stopper 4 with the cover 1 can be pushed the rest of the way into the neck 3, as indicated above, to hermetically seal the vessel 2.

When it is desired to access the contents of the vessel 2, the cap 23 is separated from the cover, for example by pulling on a sector 24 of the cap. After that, the upper portion 4C of the stopper 4 need only be pierced with a needle to penetrate into the vessel 2. The contents of the vessel 2 can then be used and, if need be, rehydrated.

Any attempt to remove the locking cover 1 from the vessel 2 will result in damage to the breakaway regions 10A of the cage 6, so single use of the vessel 2 is assured.

It will also be noted that since the stopper 4 is inserted in the cover 1 after the assembly of the cage 6, the ring 7 and the cap 23 to form the cover 1, the cover 1 and the stopper 4 can advantageously be stored separately before use.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. A locking cover for use in fixing a stopper in a neck of a vessel, the locking cover comprising:

a cage having locking tabs, the cage structured to surround the stopper and the neck and to lock the stopper and the neck in a fixed position relative to each other in an axial direction;

a ring fastened around the cage, the ring including a central aperture through which the stopper is accessible from externally of the cover; and a cap removably closing the aperture, the cap including a head dimensioned to cover the aperture and a plurality of attachment tabs projecting substantially perpendicularly from the head, the attachment tabs spaced from one another along an annular periphery of the aperture of the ring and captured between the ring and the cage.

2. The locking cover of claim 1, wherein the ring and the cage exert a clamping force on the attachment tabs.

3. The locking cover of claim 1, wherein the ring and the cage engage the attachment tabs to bend the attachment tabs in a direction oblique to the axial direction.

4. The locking cover of claim 3, wherein the oblique direction is perpendicular to the axial direction.

5. The locking cover of claim 1, wherein the attachment tabs each have a free end provided with a bead.

6. A method for fixing a stopper in a neck of a vessel using a locking cover comprising a cage configured to surround the stopper, a ring configured to surround the cage and having a partially closed top defining an aperture extending therethrough, and a cap configured to cover the aperture, the method comprising:

placing the cap on the ring such that a plurality of attachment tabs of the cap extend in an axial direction through the aperture of the ring; and inserting the cage into the ring to capture the attachment tabs between the ring and the cage.

7. The method of claim 6, further comprising engaging the attachment tab with the cage to bend the attachment tab in a direction oblique to the axial direction.

8. The method of claim 6, wherein the attachment tab is one of a plurality of attachment tabs.

9. The method of claim 6, further comprising inserting a head of the stopper into the cage and inserting a foot of the stopper into the neck of the vessel.

10. The method of claim 6, further comprising deterring tampering of a medicinal substance in the vessel by preventing access to the cage.

11. The method of claim 6, further comprising removing the cap from the aperture and inserting a needle through the aperture and the stopper.

12. A locking cover for fixing a stopper in a neck of a vessel, the locking cover comprising:

a cage including a hollow and substantially cylindrical body receiving the stopper, a first plurality of tongues extending radially inward from the body, and a second plurality of tongues axially offset from the first plurality of tongues and extending radially inward from the body, the first plurality of tongues engaging the neck of the vessel to axially position the locking cover relative to the neck, the second plurality of tongues engaging the stopper to axially position the stopper within the cage;

a ring including a hollow and substantially cylindrical body configured to surround the cage and having an open bottom and a partially closed top, the partially closed top defining an aperture extending axially therethrough; and a cap including a head covering the aperture to prevent access to the stopper and an attachment member extending in an axial direction through the aperture to attach the cap to the ring.

13. The locking cover of claim 12, wherein the attachment member includes a plurality of tabs that are spaced apart from one another around a perimeter of the aperture when the plurality of tabs are inserted into the aperture.

14. The locking cover of claim 13, wherein the cage engages the plurality of tabs to bend the plurality of tabs in a direction oblique to the axial direction when the cage is inserted into the ring after the plurality of tabs are inserted into the aperture.

15. The locking cover of claim 14, wherein the plurality of tabs are captured between an upper surface of the cage and an underside surface of the ring when the cage is inserted into the ring after the plurality of tabs are inserted into the aperture.

16. The locking cover of claim 15, wherein a free end of each of the plurality of tabs includes a bead that is larger than a gap between the upper surface of the cage and the underside surface of the ring.

17. The locking cover of claim 12, wherein the head has a disk shape.

18. The locking cover of claim 12, wherein the partially closed top of the ring extends radially inward over the cage.

19. The locking cover of claim 12, wherein the second plurality of tongues are configured to engage an underside surface of the stopper to support the stopper within the ring.

20. A locking cover for fixing a stopper in a neck of a vessel, the locking cover comprising:

an inner member configured to receive the stopper and including a first projection configured to engage the neck of the vessel to fix the locking cover relative to the neck, a second projection configured to engage the stopper to fix the stopper within the inner member, and a breakaway region configured to break before the first projection disengages from the neck when a removal force is applied to the locking cover;

an outer member configured to surround the inner member and having an open bottom and a partially closed top, the partially closed top defining an aperture extending axially therethrough; and a cover member configured to cover the aperture in the outer member to prevent access to the stopper when the stopper is inserted into the inner member and the outer member surrounds the inner member.

21. The locking cover of claim 20, wherein the cover member includes a head configured to cover the aperture and a plurality of tabs configured to extend in an axial direction through the aperture when the head covers the aperture.

22. The locking cover of claim 21, wherein the inner member engages the plurality of tabs to bend the plurality of tabs in a direction oblique to the axial direction when the inner member is inserted into the outer member after the plurality of tabs are inserted into the aperture.

23. The locking cover of claim 22, wherein the plurality of tabs are captured between an upper surface of the inner member and an underside surface of the outer member when the inner member is inserted into the outer member after the plurality of tabs are inserted into the aperture.

24. The locking cover of claim 23, wherein a free end of each of the plurality of tabs includes a bead that is larger than a gap between the upper surface of the inner member and the underside surface of the outer member.

25. A locking cover for fixing a stopper in a neck of a vessel, the locking cover comprising:

an inner member configured to receive the stopper and including a first projection configured to engage the neck of the vessel to fix the locking cover relative to the neck, a second projection configured to engage the stopper to fix the stopper within the inner member, and a breakaway region configured to break before the first projection disengages from the neck when a removal force is applied to the locking cover;

an outer member configured to surround the inner member and having an open bottom and a partially closed top, the partially closed top defining an aperture extending axially therethrough; and a cover member configured to cover the aperture in the outer member to prevent access to the stopper when the stopper is inserted into the inner member and the outer member surrounds the inner member, wherein the breakaway region has a first cross sectional area that is less than a second cross sectional area of a remainder of the outer member.

26. The locking cover of claim 20, wherein the inner member defines an opening extending radially therethrough, and the breakaway region is disposed between the opening and an end surface of the inner member.

27. The locking cover of claim 26, wherein the opening includes a plurality of openings and the breakaway region has a first thickness that is less than a second thickness of the inner member between the plurality of openings.

28. A locking cover for fixing a stopper in a neck of a vessel, the locking cover comprising:

a cage including a hollow and substantially cylindrical body configured to receive the stopper, a first plurality of tongues extending radially inward from the body, a second plurality of tongues axially offset from the first plurality of tongues and extending radially inward from the body, and a plurality of catches extending radially outward from the body, the second plurality of tongues being configured to engage the stopper to axially position the stopper relative to the cage when the stopper in inserted into the cage, the body including a breakaway region configured to break when a removal force is applied to the locking cover;

a hollow and substantially cylindrical ring configured to radially overlap and surround the cage and having an open bottom and a partially closed top, the partially closed top defining an aperture extending therethrough, the ring defining a plurality of notches configured to receive the plurality of catches on the cage to axially position the cage relative to the ring; and a cap including a head configured to cover the aperture to prevent access to the stopper and an attachment member configured to extend axially into the aperture to attach the cap to the ring.

* * * * *